US008925830B2

(12) United States Patent
Brown, Jr. et al.

(10) Patent No.: US 8,925,830 B2
(45) Date of Patent: Jan. 6, 2015

(54) TRACTION JACK

(75) Inventors: Jeffrey Brown, Jr., El Paso, TX (US); Carlos Amaro, El Paso, TX (US)

(73) Assignee: Traction Jack, Albuquerque, NM (US)

( * ) Notice: Subject to any disclaimer, the term of this patent is extended or adjusted under 35 U.S.C. 154(b) by 457 days.

(21) Appl. No.: 13/031,913

(22) Filed: Feb. 22, 2011

(65) Prior Publication Data

US 2011/0204152 A1 Aug. 25, 2011

Related U.S. Application Data

(60) Provisional application No. 61/306,604, filed on Feb. 22, 2010, provisional application No. 61/438,322, filed on Feb. 1, 2011.

(51) Int. Cl.
*E01B 23/00* (2006.01)
*B66F 3/24* (2006.01)

(52) U.S. Cl.
CPC ..... *B66F 3/24* (2013.01)
USPC ..... 238/14

(58) Field of Classification Search
USPC ..... 238/10 R, 14; 291/1, 2
See application file for complete search history.

(56) References Cited

U.S. PATENT DOCUMENTS

| | | | | |
|---|---|---|---|---|
| 2,227,750 | A | 1/1941 | Hinson | |
| 2,420,130 | A * | 5/1947 | Foss | 254/88 |
| 3,708,117 | A | 1/1973 | Coale | |
| 3,858,803 | A | 1/1975 | Gantert | |
| 4,300,722 | A | 11/1981 | Simmons | |
| 5,402,941 | A | 4/1995 | MacLeod | |
| 5,855,359 | A | 1/1999 | Chipperfield | |
| 6,314,602 | B1 * | 11/2001 | Wallen | 14/69.5 |
| 6,779,738 | B1 | 8/2004 | Stannard | |
| 7,003,836 | B2 | 2/2006 | Berg | |
| 7,526,826 | B2 * | 5/2009 | Bailie | 14/69.5 |
| 2007/0234491 | A1 | 10/2007 | Bailie | |
| 2009/0300859 | A1 | 12/2009 | Lucht | |

* cited by examiner

*Primary Examiner* — R. J. McCarry, Jr.
(74) *Attorney, Agent, or Firm* — Melissa Silverstein; Luis M. Ortiz; Kermit D. Lopez

(57) ABSTRACT

A vehicle traction jack that functions as a traction mat platform, ramp, and vehicle jack to assist a vehicle's tire when a tire is stuck in a rut, hole, or some sort of terrain or weather condition such as sand, gravel, dirt, mud, or snow is disclosed. The traction jack comprises a first plate and second plate, a hinge assembly, and a jack. The first and second plates can extend to a partially-opened or fully-opened position, forming a ramp and traction mat platform. The extended traction jack can be placed in front of or behind a vehicle's tire to provide addition traction. A jack extends from at least one plate of the vehicle traction jack to raise a vehicle for repairs to the vehicle's tire. Easily stored in a vehicle at all times, a single user can use the traction jack to help move any type of vehicle's tire.

15 Claims, 4 Drawing Sheets

TRACTION JACK

CROSS REFERENCE TO RELATED APPLICATIONS

This patent application claims the priority and benefit under 35 U.S.C. §119(e) of U.S. Provisional Patent Application Ser. No. 61/306,604 filed on Feb. 22, 2010, and entitled "Traction Jack," and U.S. Provisional Patent Application Ser. No. 61/438,322 filed on Feb. 1, 2011, which are hereby incorporated by reference in their entirety.

TECHNICAL FIELD

The disclosed embodiments relate to traction devices. The disclosed embodiments further relate to techniques for providing additional traction for a vehicle's tires for removal from loose terrain or adverse weather conditions. The disclosed embodiments also relate to a vehicle ramp and jack for raising a vehicle for repair.

BACKGROUND OF THE INVENTION

Various devices have been developed for improving traction between a vehicle's tires and a road surface made slippery by adverse weather or inferior roadbed conditions such as ice, snow, mud, and desert sand. Proposed traction devices help a vehicle drive out of a rut or pothole by gaining additional traction from materials placed into the path of the tires. Such traction aids include boards, burlap bags, pieces of carpeting, tire chains, and various bulky ramps, for example. These makeshift means are generally ineffective when caught and thrown out by the rotating tires. Typically, a standard block of wood is used with the assistance of numerous people to free off-roaders in desert terrain, which often leads to damaged tires and vehicles.

Other traction devices are prohibitively expensive to purchase and unsafe to handle because of sharp edges and heavy components. Prior traction mats are often difficult to position beneath the vehicle's tires for use. When a vehicle's tires become mired in snow, mud, or desert sand for some depth, the resulting ruts formed by the vehicle's tires are often deep and steeply sloping. Flexible traction mats tend to closely conform to steeply sloping walls of a rut or may sink in various road conditions, making it difficult for a vehicle to climb out under its own power. When a prior traction mat is used to extricate a vehicle from such an environment, the tire frequently engages and slides against the leading or front edge of the mat without gaining a satisfactory grip.

A motorist may want access to a variety of vehicle tools without having to store numerous devices in the vehicle. While traction mats and other aids such as jacks and repair ramps can be carried in a vehicle, they fight for storage space with other items. Manual and automated vehicle jacks are usually carried in a vehicle and used principally to assist a motorist with changing a vehicle's tire. A manual jack that attaches to the bumper or frame of vehicle at designated points is a widely used method of jacking or lifting a vehicle. After placement, a manual jack is usually cranked to lift the vehicle and repair a desired tire. An all-in-one traction jack device needs to save the motorist time and effort by helping the tires to regain traction for return to the roadway and to eliminate the high cost of an emergency road service truck for winching the stranded vehicle from a slippery hole or rut.

Accordingly, there exists a need for an effective, space-saving vehicle traction jack device that provides additional traction and a ramped surface to lend traction to move a vehicle's tires when the tires are stuck in loose terrain or weather conditions.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is therefore an object of the disclosed embodiments to provide a space-saving vehicle traction and jack device.

It is another object of the disclosed embodiments to provide a ramped-surface to assist a vehicle's tires when the tires are stuck in loose terrain or adverse weather conditions.

It is an additional object of the disclosed embodiments to provide an all-in-one vehicle traction surface, ramp, and jack for raising a vehicle for repair.

The above and other aspects can be achieved as is now described. A vehicle traction jack that functions as a traction mat platform, ramp, and vehicle jack to assist a vehicle's tire when a tire is stuck in a rut, hole, or some sort of terrain or weather condition, such as sand, gravel, dirt, mud, or snow is disclosed. The traction jack comprises a first plate and second plate, a hinge assembly, and a jack. The first and second plates can extend to a partially-opened or fully-opened position, forming a ramp and traction mat platform. The extended traction jack can be placed in front of or behind a vehicle's tire to provide addition traction. A jack extends from at least one plate of the vehicle traction jack to raise a vehicle for repairs to the vehicle's tire. Easily stored in a vehicle at all times, a single user can use the traction jack to help move any type of vehicle's tire.

A traction jack apparatus described herein comprises: a first plate, a hinge assembly attached to said first plate, a second plate attached to said hinge assembly, wherein said hinge assembly provides a rotational range of motion and articulated adjustability between said first plate and said second plate for positioning said traction jack between a vehicle's tire and a surface, and a vehicle jack attached to said first plate for extending an angle between said first plate and said second plate from a closed position to a partially-opened position or a fully-opened position, to provide a ramp to assist said vehicle's tire when said vehicle's tire is stuck on said surface. The surface can be anything from a rut, hole, roadway condition, such as sand, gravel, dirt, mud, or snow, or any type of weather condition. The partially-opened position of said first plate and said second plate forms an angle less than 180°. The fully-opened of said first plate and said second plate forms and angle greater than or equal to 180°. The fully-opened position of said first plate and said second plate provides access to said attached vehicle jack or an extended high-traction surface of said first plate and said second plate to assist a stuck said vehicle tire.

The first plate and second plate are rigid and rectangular surfaces capable of supporting said vehicle. Both the first plate and second plate can be covered in an anti-slip, high traction surface with a high coefficient of friction for frictional engagement with said vehicle's tire. The first and second plates can be made of any type of metal, such as steel or aluminum, for example. The vehicle jack attached to said first plate extends upward when said first plate lies flat on said surface, wherein said vehicle jack comprises at least one of the following: a bottle jack, a telescoping jack, a floor jack, or a hydraulic jack. The second plate can be folded at said hinge assembly such that an underside surface of said second plate rests upon said vehicle jack and a high traction surface covering said second plate faces upward. The second plate has a plurality of nobs attached to an underside of said second plate, wherein said nobs receive a top portion an extended said vehicle jack to prevent said second plate from moving laterally when supporting said vehicle.

Another traction jack apparatus described herein comprises: a first plate, a hinge assembly attached to said first plate, a second plate attached to said hinge assembly, wherein said hinge assembly provides a rotational range of motion and articulated adjustability between said first plate and said second plate for positioning said traction jack between a vehicle's tire and a surface, and a vehicle jack attached to said first plate for extending an angle between said first plate and said second plate from a closed position to a partially-opened position less than 180°, or a fully-opened position, wherein a cut-out edge of said first plate receives an extension edge of said second plate to form an angle between said first plate and said second plate of greater than or equal to 180° to provide a traction ramp to assist said vehicle's tire when said vehicle's tire is stuck on said surface. The first plate and second plate comprise rigid and rectangular metal surfaces capable of withstanding the weight of said vehicle, wherein said first plate and said second plate are covered in an anti-slip, high traction surface with a high coefficient of friction for frictional engagement with said vehicle's tire. The vehicle jack attached to said first plate extends upward when said first plate lies flat on said surface, wherein said vehicle jack comprises at least one of the following: a bottle jack, a telescoping jack, a floor jack, or a hydraulic jack.

A method for assisting a vehicle's tire when said vehicle tire is stuck in a roadway or weather condition is also described herein. This method comprises providing a traction jack device comprising a first plate covered in a high-traction material, a hinge assembly attached to said first plate, wherein said hinge assembly provides a full rotational range of motion and articulated adjustability between said first plate and said second plate for positioning said traction jack device between a vehicle's tire and a surface, a second plate covered in a high-traction material attached to said hinge assembly, and vehicle jack attached to said first plate, extending said vehicle jack attached to said first plate, wherein said second plate rests on a top portion of said extended vehicle jack to form an angled vehicle ramp, and positioning said angled vehicle ramp behind or in front of a stuck said vehicle's tire to provide a high-traction, ramped surface to support said vehicle escape said roadway or weather condition. The vehicle jack can be extended from a closed position to a partially opened position comprising an angle less than 180° between said first plate and said second plate, or a fully-opened position comprising an angle equal to or greater than 180° between said first plate and said second plate. The fully-opened position provides access to said vehicle jack attached to said first plate or to an extended high-traction surface of said first plate and said second plate to assist a stuck said vehicle tire. A plurality of traction jack devices can be placed in front of or behind said vehicle's tires to provided additional traction to said tires.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

The embodiments now will be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout, As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms such as those defined in commonly used dictionaries, should be interpreted as having a meaning that is consistent with their meaning in the context of the relevant art and will not be interpreted in an idealized or overly formal sense unless expressly so defined herein.

Figure 1:
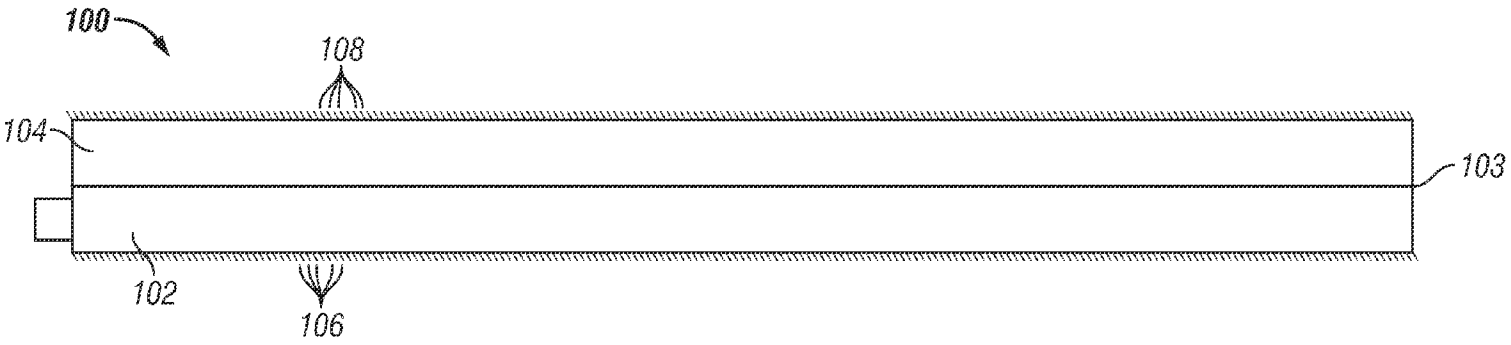
FIG. 1 illustrates a side elevation view of the traction jack in a dosed position, in accordance with the disclosed embodiments.
Figure 2:
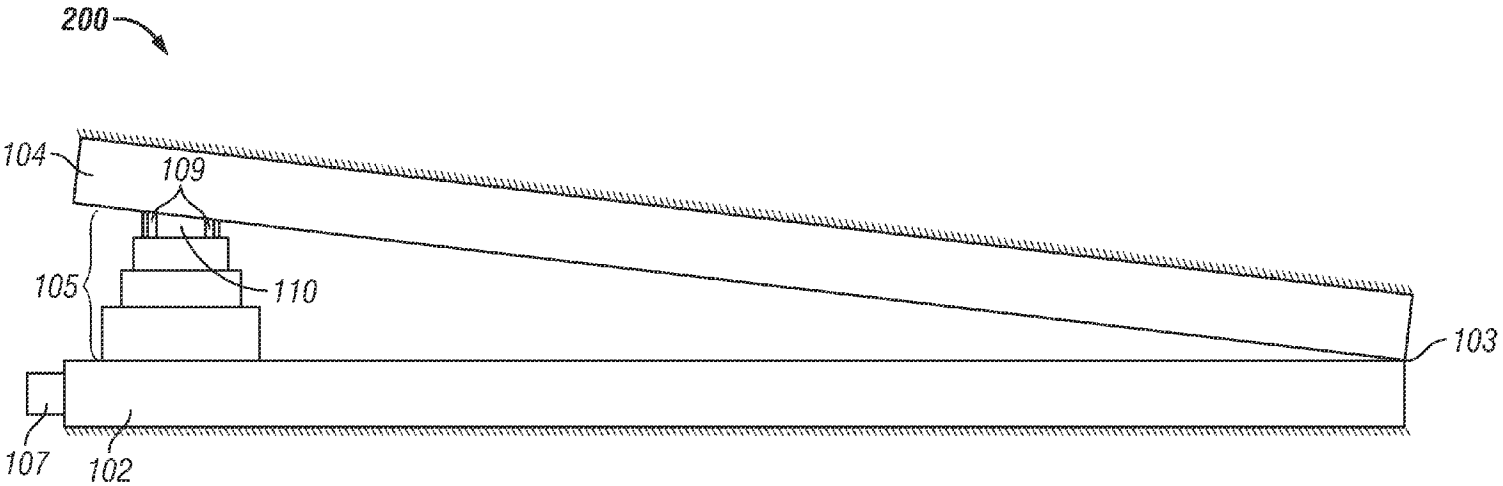
FIG. 2 illustrates a side elevation view of the traction jack in a partially opened position, in accordance with the disclosed embodiments.

FIG. 1 illustrates a side elevation view of the traction jack in a dosed position 100, in accordance with the disclosed embodiments. The traction jack 100 functions as a combination traction mat platform, ramp, and vehicle jack to assist a vehicle's tire when a tire is stuck in a rut, hole, a roadway surface, or some sort of terrain or weather condition such as sand, gravel, dirt, mud, or snow, for example. The traction jack 100 comprises a first plate 102 and second plate 104, a hinge assembly 103, and a jack 105 (as illustrated in FIG. 2). The first plate 102 is a rigid and rectangular surface capable of withstanding the weight of a vehicle. The first plate 102 is covered in an anti-slip, high traction surface 106, such as, for example, recycled tire tread or any type of adhered abrasive material to lend additional traction, but is not limited to those items. The high traction surface 106 can completely cover the first plate 102 or can be arranged in strips or cover portions of the first plate 102, for example. The second plate 104 is a rigid, rectangular surface of the same size and material construction of the first plate 102. The second plate 104 is also covered in an anti-slip, high traction surface 108. The high traction surface 108 can completely cover the second plate 104 or can be arranged in strips or cover portions of the second plate 104, for example. The high traction surfaces 106, 108 possess high coefficients of static friction for frictional engagement with a vehicle's tire.

The first plate 102 and second plate 104 can be comprised of metal such as, for example, steel or aluminum, but is not limited solely to these types of materials. The vehicle traction jack 100 is appropriately sized to receive and lift any size vehicle tire. For example, an exemplary first plate 102 and an exemplary second plate 104 of the vehicle traction jack 100 can measure approximately ten to twelve inches wide and approximately two feet long. The vehicle traction jack 100 can be sized to receive larger, after-market tires, with an exemplary first plate 102 and an exemplary second plate 104 measuring approximately twelve inches wide by sixteen inches long. It is understood that all dimensions of the first plate 102 and the second plate 104 are provided for illustrative purposes only and do not limit the disclosed embodiments to those particular dimensions.

FIG. 2 illustrates a side elevation view of the traction jack in a partially opened position 200, in accordance with the disclosed embodiments. Extending the jack 105 to create a ramp using the first plate 102 and second plate 104 allows a vehicle to be driven up onto the partially-opened vehicle traction jack 200. The height of the ramp is controlled by the user extending the jack 105. The appropriately-sized first plate 102 and second plate 104 supports the vehicle for repairs underneath the vehicle and/or to the vehicle's tire. The hinge assembly 103 comprises at least one hinge member and the hinge member's attachments that connect the first plate 102 and second plate 104 along a shorter side of each plate 102, 104. The hinge assembly 103 provides the first plate 102 and the second plate 104 with a full rotational range of motion and articulated adjustability for positioning the traction jack 200 between a tire and a surface. The hinge assembly 103 allows the first plate 102 and second plate 104 to open to a partially opened position (e.g., less than 180°) and a fully opened position (e.g., greater than or equal to 180°). The hinge assembly 103 allows the traction jack 200 to be folded into a closed position, or to one half of its fully opened length, for easy transport and storage.

The jack 105 comprises a vehicle jack attached to the first plate 102 such that the first plate 102 can He flat on the ground with the jack 105 extending upward. The jack 105 can be, for example, a bottle jack, a telescoping jack, a floor jack, or any type of a hydraulic jack. A notch 107 extends from the first plate 102 as a connection point to raise and lower the jack 105. When the jack 105 is extended, the underside of the second plate 104 has a plurality of nobs 109 to receive the top portion 110 of the extended jack 105. The plurality of nobs 109 prevents the second plate 104 from moving laterally when supporting a vehicle. The second plate 104 may be folded along the hinge assembly 103 such that the underside surface of the second plate 104 rests upon the top of the jack 105 and the high traction surface 108 faces upward.

Figure 3:
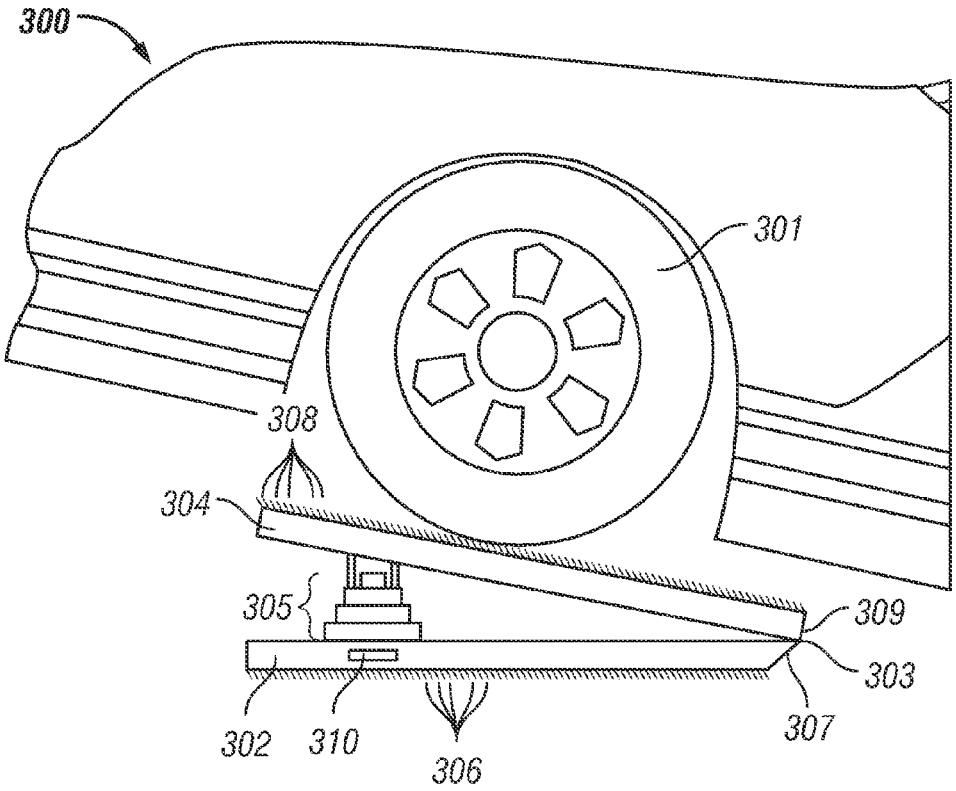
FIG. 3 illustrates a side elevation view of the traction jack in a partially opened position while supporting a vehicle's tire, in accordance with the disclosed embodiments.

FIG. 3 illustrates a side elevation view of the traction jack in a partially opened position 300 while supporting a vehicle's tire 301, in accordance with the disclosed embodiments. The vehicle traction jack can be placed in front of or behind one or more of a vehicle's tire 301 to provide traction to said tire 301 and permit the vehicle to be driven out of the sand, mud, snow, etc. In another embodiment, the first plate 302 can have a cut-out edge 307 to receive the edge 309 of the second plate 304. When the hinge assembly 303 opens from a partially opened position (e.g., less than 180°) to a fully opened position (e.g., greater than or equal to 180°), the edge 309 of the second plate 304 fits into the cut-out edge 307 of the first plate 302. Both the first plate 302 and the second plate 304 can be covered in an anti-slip, high traction surface 306, 308 such as, for example, recycled tire tread or any type of adhered abrasive material to lend additional traction, but is not limited to those items. A jack 305 extends upward from the first plate 302. When extended, the jack 305 creates an angled ramp between the first plate 302 and second plate 304. The first plate 302 has an insertion space 310 to receive a tool to extend and retract the jack 305.

Figure 4:
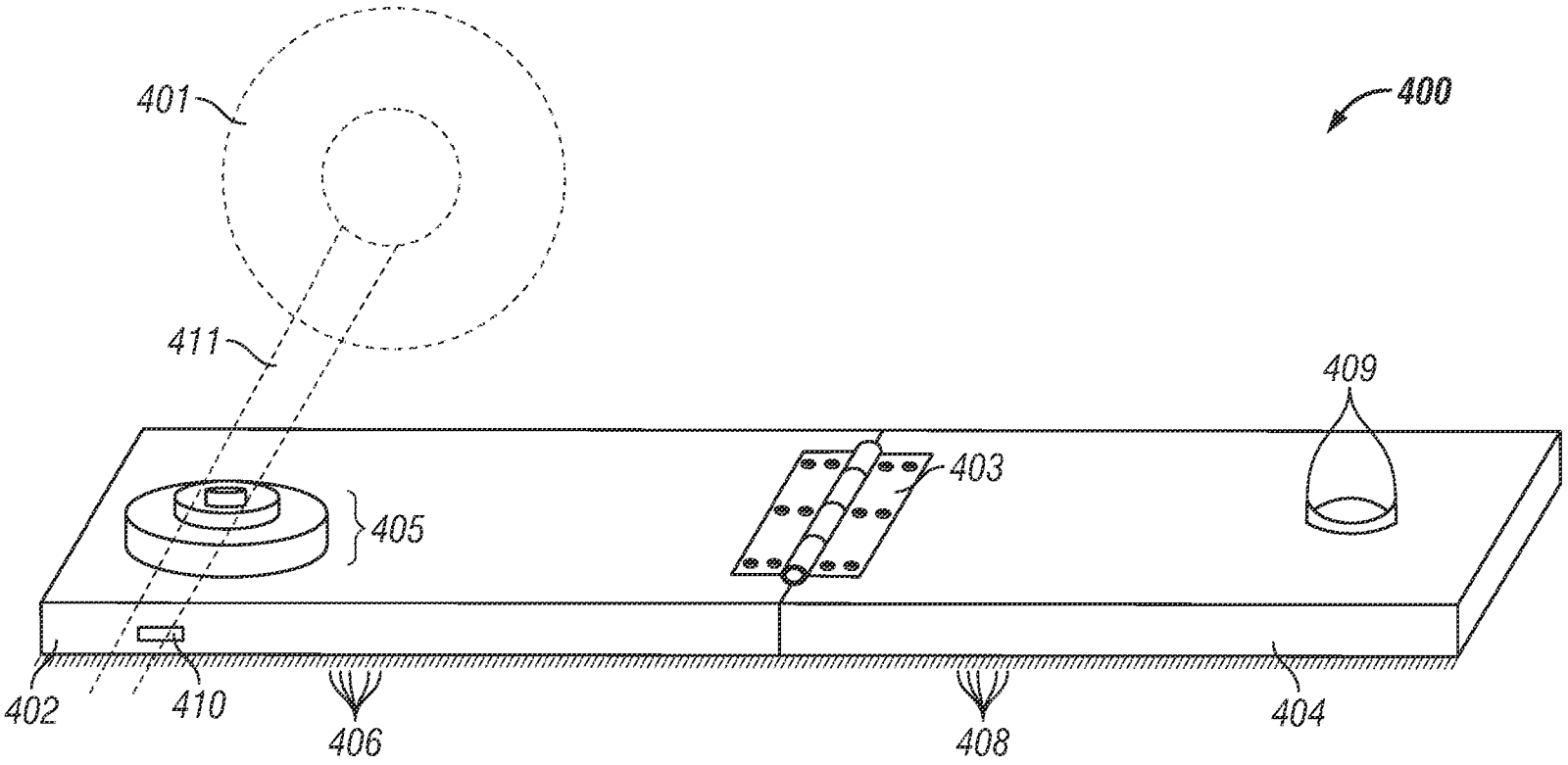
FIG. 4 illustrates a perspective view of a first side of the traction jack in a fully-opened position, in accordance with the disclosed embodiments.

FIG. 4 illustrates a perspective view of a first side of the traction jack in a fully-opened position 400, in accordance with the disclosed embodiments. The fully opened vehicle traction jack 400 can be used as a traditional jack 405 to lift a vehicle's axle 411 and repair, remove, and/or replace a tire 401. The jack 405 supports the axle 411 attached to a vehicle's tire 401, An insertion space 410 allows a user to extend and retract the jack 405. When in the fully-opened position 400, the high-traction surfaces 406, 408 of the first plate 402 and second plate 404, respectively, lay flat on the ground. The hinge assembly 403 is fully extended to form an angle greater than or equal to 180°. A plurality of nobs 409 extend upward from the underside of the second plate 404.

Figure 5:
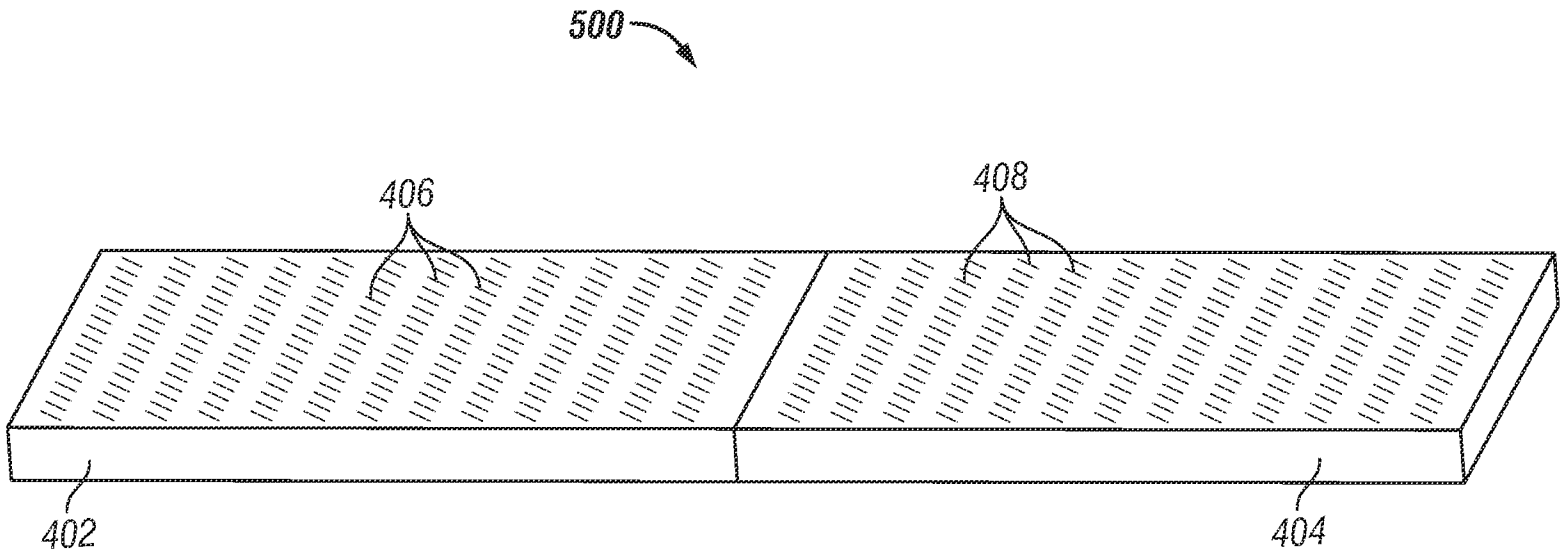
FIG. 5 illustrates a perspective view of a second side of the traction jack in a fully-opened position, in accordance with the disclosed embodiments.

FIG. 5 illustrates a perspective view of a second side of the traction jack in a fully-opened position 500, in accordance with the disclosed embodiments. The fully opened vehicle traction jack 500 can be used as a traction mat platform to provide additional traction for a vehicle's tire. When in the fully-opened position 500, the high-traction surfaces 406, 408 of the first plate 402 and second plate 404, respectively, extend upward. The hinge assembly 403 is fully extended to form an angle greater than or equal to 180°. The plurality of nobs 409 (not illustrated) that extend from the underside of the second plate 404 lay flat on the ground, along with the jack 405 (not illustrated) attached to the underside of the first plate 402.

The disclosed embodiments 100 to 500 of the vehicle traction jack can be adjusted and reconfigured to perform different tasks such as assisting in vehicle repair on the underside of vehicle and rescuing a vehicle from loose material on roadways and unpaved surfaces. The vehicle traction jack can free any type of vehicle including such as, for example, cars, trucks, sport utility vehicles ("SUVs"), all-terrain vehicles ("ATVs"), motorcycles, etc. Military vehicles may need a way to escape loose sand and dirt. Easily stored in a vehicle at all times, the lightweight vehicle traction jack can be used by only one person. Any number of disclosed vehicle traction jacks can be used at one time to dislodge a vehicle by placing the vehicle traction jack either in front of or behind a vehicle's tire.

It will be appreciated that variations of the above-disclosed and other features and functions, or alternatives thereof, may be desirably combined into many other different systems or applications. Furthermore, various presently unforeseen or unanticipated alternatives, modifications, variations or improvements therein may be subsequently made by those skilled in the art, which are also intended to be encompassed by the following claims.

The invention claimed is:

1. A traction jack apparatus, comprising:

a first plate, wherein said first plate comprises a rigid and rectangular surface capable of supporting said vehicle, wherein said first plate is permanently covered in an anti-slip, high traction surface with a high coefficient of friction for frictional engagement with said tire of said vehicle;

a hinge assembly attached to said first plate;

a second plate attached to said hinge assembly, wherein said hinge assembly provides a rotational range of motion and articulated adjustability between said first plate and said second plate for positioning said traction jack between a tire of a vehicle and a surface; and a vehicle jack attached to said first plate and in contact with a surface of said second plate when said vehicle lack is extended, wherein said vehicle jack comprises at least one of a bottle jack, a telescoping jack, a floor jack, or a hydraulic jack, wherein said vehicle jack extends an angle between said first plate and said second plate from a closed position to a partially-opened position or a fully-opened position to provide a ramp to assist said tire of said vehicle when said tire of said vehicle is stuck on said surface, wherein said second plate is folded at said hinge assembly to expose a high traction surface covering said first plate to a surface of said vehicle tire.

2. The apparatus of claim 1 wherein said surface comprises a rut, hole, roadway condition, or weather condition.

3. The apparatus of claim 1 wherein said second plate comprises a rigid and rectangular surface capable of supporting said vehicle, wherein said second plate is covered in an anti-slip, high traction surface with a high coefficient of friction for frictional engagement with said tire of said vehicle.

4. The apparatus of claim 1 wherein said first plate and said second plate are comprised of steel or aluminum.

5. The apparatus of claim 1 wherein said partially-opened position of said first plate and said second plate forms an angle less than 180°.

6. The apparatus of claim 1 wherein said fully-opened of said first plate and said second plate forms an angle greater than or equal to 180°.

7. The apparatus of claim 1 wherein said second plate has a plurality of nobs attached to an underside of said second plate, wherein said nobs rest on a top portion of said extended vehicle jack to prevent said second plate from moving laterally when supporting said vehicle.

8. The apparatus of claim 1 wherein said fully-opened position of said first plate and said second plate provides access to said attached vehicle jack or an extended high-traction surface of said first plate and said second plate to assist a stuck said vehicle tire.

9. A traction jack apparatus, comprising:

a first plate, wherein said first plate comprises a rigid and rectangular surface capable of supporting said vehicle, wherein said first plate is permanently covered in an anti-slip, high traction surface with a high coefficient of friction for frictional engagement with said tire of said vehicle;

a hinge assembly attached to said first plate;

a second plate attached to said hinge assembly, wherein said hinge assembly provides a rotational range of motion and articulated adjustability between said first plate and said second plate for positioning said traction jack between a tire of a vehicle and a surface; and a vehicle jack attached to said first plate and in contact with a surface of said second plate when said vehicle jack is extended, wherein said vehicle jack comprises at least one of a bottle jack, a telescoping jack, a floor jack, or a hydraulic jack, wherein said vehicle jack extends between said first plate and said second plate from a closed position to a partially-opened position less than 180°, or a fully-opened position, wherein a cut-out edge of said first plate receives an edge of said second plate to form an angle between said first plate and said second plate of greater than or equal to 180° to provide a traction ramp to assist said vehicle's tire when said tire of a vehicle is stuck on said surface, wherein said second plate is folded at said hinge assembly to expose a high traction surface covering said first plate to a surface of said vehicle tire.

10. The apparatus of claim 9 wherein said second plate comprises a rigid and rectangular metal surface capable of supporting said vehicle, wherein said second plate is covered in an anti-slip, high traction surface with a high coefficient of friction for frictional engagement with said tire of said vehicle.

11. A method for assisting a tire of a vehicle tire when said vehicle tire is stuck in a roadway or weather condition, comprising:

providing a traction jack device comprising a first plate permanently covered in an anti-slip, high traction surface with a high coefficient of friction for fractional engagement with said tire of said vehicle , a hinge assembly attached to said first plate, wherein said hinge assembly provides a rotational range of motion and articulated adjustability between said first plate and said second plate for positioning said traction jack device between a tire of a vehicle and a surface, a second plate covered in a high-traction material attached to said hinge assembly, and vehicle jack attached to said first plate, wherein said vehicle jack comprises at least one of a bottle jack, a telescoping jack, a floor jack, or a hydraulic jack, wherein said vehicle jack;

extending said vehicle jack attached to said first plate and in contact with a surface of said second plate, wherein said second plate rests on a top portion of said extended vehicle jack to form an angled vehicle ramp, wherein said second plate is folded at said hinge assembly to expose a high traction surface covering said first plate to a surface of said vehicle tire; and positioning said angled vehicle ramp behind or in front of a stuck said tire of said vehicle to provide a high-traction, ramped surface to support said vehicle to escape said roadway or weather condition.

12. The method of claim 11 further comprising extending said vehicle jack from a closed position to a partially opened position comprising an angle less than 180° between said first plate and said second plate, or a fully-opened position comprising an angle equal to or greater than 180° between said first plate and said second plate.

13. The method of claim 11 further comprising extending said traction jack device into a fully-opened position to raise said vehicle using said vehicle jack attached to said first plate.

14. The method of claim 11 further comprising extending said traction jack device into a fully-opened position to provide an extended high-traction surface of said first plate and said second plate to assist a stuck said vehicle tire.

15. The method of claim 11 further comprising placing a plurality of traction jack devices in front of or behind said tires of said vehicle to provided additional traction to said tires.

* * * * *